US006948288B1

(12) United States Patent
Smith

(10) Patent No.: US 6,948,288 B1
(45) Date of Patent: Sep. 27, 2005

(54) ROOF TILE SUPPORT

(76) Inventor: Gary E. Smith, 5219 Fanwood Dr., Huntington Beach, CA (US) 92649

( * ) Notice: Subject to any disclaimer, the term of this patent is extended or adjusted under 35 U.S.C. 154(b) by 0 days.

(21) Appl. No.: 09/692,655

(22) Filed: Oct. 19, 2000

(51) Int. Cl.[7] ..... E04D 1/12; E04D 1/34; E04D 13/12

(52) U.S. Cl. ..... 52/409; 52/478; 52/309.8; 52/518; 52/551; 52/552; 52/553; 52/560; 52/748.1

(58) Field of Search ..... 52/309.4, 309.8, 52/409, 553, 560, 408, 747.11, 748.1, 518, 52/550, 551, 519, 478, 552

(56) References Cited

U.S. PATENT DOCUMENTS

| | | | | | |
|---|---|---|---|---|---|
| 368,386 | A | | 8/1887 | Donaldson | |
| 1,438,302 | A | * | 12/1922 | Frederiksen | 52/748.1 |
| 1,865,771 | A | * | 7/1932 | Levy | 52/521 |
| 1,963,583 | A | | 6/1934 | Jenkins | |
| 2,062,149 | A | * | 11/1936 | Stark et al. | 52/544 |
| 2,110,579 | A | | 3/1938 | Robinson | |
| 2,264,546 | A | | 12/1941 | Ochs | |
| 2,418,758 | A | | 4/1947 | Cooper | |
| 2,592,482 | A | | 4/1952 | Sperry | |
| 2,727,283 | A | * | 12/1955 | Gollner | 52/478 |
| 2,823,426 | A | * | 2/1958 | Dunlap | 52/541 |
| 3,248,835 | A | | 5/1966 | Westlind | |
| 3,380,215 | A | * | 4/1968 | Schaefer et al. | 52/522 |
| 3,473,274 | A | * | 10/1969 | Godes | 52/127.5 |
| 3,520,099 | A | | 7/1970 | Mattes | |
| 3,552,078 | A | | 1/1971 | Mattes | |
| 3,605,369 | A | | 9/1971 | Merrill et al. | |
| RE27,502 | E | * | 10/1972 | Martin | 52/94 |
| 3,703,795 | A | * | 11/1972 | Mattes | 52/521 |
| 3,780,483 | A | * | 12/1973 | Mattes | 52/550 |
| 3,826,054 | A | | 7/1974 | Culpepper, Jr. | |
| RE28,583 | E | * | 10/1975 | Hughes | 52/560 |
| 4,033,802 | A | | 7/1977 | Culpepper, Jr. et al. | |
| 4,065,899 | A | | 1/1978 | Kirkhuff | |
| 4,081,939 | A | | 4/1978 | Culpepper, Jr. et al. | |
| 4,120,132 | A | * | 10/1978 | Kendrick | 52/478 |
| 4,160,346 | A | | 7/1979 | Kaufmann | |
| 4,251,578 | A | * | 2/1981 | Kaufmann | 428/53 |
| 4,320,613 | A | | 3/1982 | Kaufman | |
| 4,355,491 | A | * | 10/1982 | Martin et al. | 52/540 |
| 4,399,643 | A | | 8/1983 | Hafner | |
| 4,432,181 | A | * | 2/1984 | Funaki | 52/459 |
| 4,445,305 | A | * | 5/1984 | Orie, Sr. | 52/309.9 |
| D274,947 | S | | 7/1984 | Culpepper, Jr. et al. | |
| 4,467,580 | A | * | 8/1984 | Sowinski | 52/302.1 |
| 4,506,486 | A | | 3/1985 | Culpepper, Jr. et al. | |
| 4,530,193 | A | * | 7/1985 | Ochs | 52/408 |
| 4,642,950 | A | * | 2/1987 | Kelly | 52/90 |
| 4,788,808 | A | * | 12/1988 | Slocum | 52/521 |
| 4,803,818 | A | | 2/1989 | Funaki | |
| 4,854,102 | A | | 8/1989 | Feil et al. | |
| 4,926,611 | A | * | 5/1990 | Funaki | 52/748.1 |
| 4,969,302 | A | | 11/1990 | Coggan et al. | |

(Continued)

FOREIGN PATENT DOCUMENTS

| | | |
|---|---|---|
| FR | 2 583 091 | 12/1986 |

*Primary Examiner*—Robert Canfield
(74) *Attorney, Agent, or Firm*—Knobbe Martens Olson & Bear, LLP

(57) ABSTRACT

A roof tile support element that fits between roof tiles and a roofing surface to provide support for the roof tiles, which is compatible with a broad range of roof tiles, is adjustable during installation, and that allows individuals to walk confidently on a tile roof without breaking tiles.

13 Claims, 7 Drawing Sheets

U.S. PATENT DOCUMENTS 5,016,415 A 5/1991 Kellis
5,056,288 A * 10/1991 Funaki ..... 52/545
5,134,831 A * 8/1992 Avellanet ..... 52/746.1
5,214,895 A 6/1993 Fifield
5,222,337 A * 6/1993 Thomsen et al. ..... 52/404
5,363,574 A * 11/1994 Osadchuk ..... 37/142.5
5,369,926 A 12/1994 Borland
5,442,888 A 8/1995 Ilnyckyj
5,473,847 A * 12/1995 Crookston ..... 52/302.1
5,502,940 A 4/1996 Fifield
5,598,677 A 2/1997 Rehm, III
5,636,489 A * 6/1997 Leverrier et al. ..... 52/540
5,664,376 A 9/1997 Wilson et al.
5,737,881 A 4/1998 Stocksieker
5,974,756 A * 11/1999 Alvarez et al. ..... 52/553
6,029,415 A 2/2000 Culpepper et al.
6,263,574 B1 7/2001 Lubker, II et al.
6,407,110 B2 * 6/2002 Bashiardes et al. ..... 514/252.1
6,487,826 B1 * 12/2002 McCorsley et al. ..... 52/408
6,526,718 B2 3/2003 Manning et al.
2001/0013211 A1 * 8/2001 Rudden ..... 52/539
2002/0029537 A1 3/2002 Manning et al.

* cited by examiner

ROOF TILE SUPPORT

BACKGROUND OF THE INVENTION

1. Field of the Invention

The present invention relates generally to roofing products, and more specifically, to a roof tile support that allows individuals to walk on a tile roof without breaking tiles.

2. Description of the Related Art

Tile is one of the predominant roofing products in use today because of its many advantages over other roofing systems. Tile has a long life span and provides good weather resistance. A tile roof requires little maintenance and is not subject to rotting or insect damage. Tile is fire safe and is available in many different colors, shapes, and styles. Additionally, cement or concrete tiles are generally lighter and cost less than traditional clay or ceramic tiles and can be used on most roofs without having to provide structural reinforcements for the roof.

One of the only disadvantages of a tile roof is that it is difficult to walk on it without breaking tiles. Sometimes it is necessary to walk on a roof to paint the trim, clean windows or gutters, and remove foreign objects. Tile roofs generally cannot take heavy traffic. Careless foot placement or just "heavy feet" can result in broken tiles. Tile is usually placed on a roof with one side secured to the roofing surface, and the other side resting on, and overlapping, another tile. This overlapping creates a space or gap beneath each tile. Stepping on the middle of a tile will likely break it because the tile is not well supported in that location.

Usually only professional roofers are able to walk on tile roofs without damaging any tiles. Yet even a professional tile installer must take great care not to break pieces while walking over the tiles. When walking on a roof, professionals have to choose a route carefully across the reinforced and supported section of each tile. They must walk on the butt of the tile where it rests on solid material, usually at the point where one tile overlaps the next. They must avoid stepping in the center of the tiles where the tiles are vulnerable to fracture. They must focus on distributing their weight evenly between both feet, and walking slowly and softly.

Some tile manufacturers have attempted to improve the "walkability" of their tiles by adding a small post on the underside of the tile that provides support for when someone steps on the middle of the tile. There are several problems with this approach. First, because the posts are an integral part of the tile and consist of the same brittle material as the tiles, they often break off during delivery, installation, or use. Second, the tiles cannot be packaged as compactly and the volume that the tiles occupy during delivery is doubled, leading to increased shipping and delivery costs.

Additionally, tile is laid according to the specific design of an individual roof. Roofers often vary the amount that each row of tiles overlaps the next row in order to cover the roofing surface with uniform rows of tile. A third problem with the posts is that the amount of overlap, or head lap, for those tiles should not be adjusted. By moving a tile forward to increase the head lap, the post does not reach the roofing surface and the tile will rest too low. In this condition, the post is not supporting the tile and the tile is likely to fracture when stepped on. By moving the tile backward to decrease the head lap, the post will be supported higher up on the roof causing the tile to rest too high. In this condition, the post is likely to snap off under a person's weight and the tile is just as likely to break as if there were no post at all.

Some tile manufacturers have introduced different support structures that are permanently attached to their tiles. The biggest problem with these tile structures is their lack of flexibility. As mentioned above, roofers need to be able to adjust the head lap of the tiles to conform to the dimensions and shapes of custom roofs. These pre-supported tile structures require precise alignment and cannot be easily modified by the installer to fit the shape of the roof. Additionally these tile structures are sometimes expensive and are not available in as many colors and styles as the individual roof tiles.

SUMMARY OF THE INVENTION

The present invention recognizes the desirability of being able to walk on a tile roof with confidence that the tiles will not break. The present invention satisfies the need for a roof tile support element that is compatible with a broad range of roof tiles, is adjustable during installation, and that allows individuals to walk confidently on a tile roof without breaking tiles.

In one embodiment of the present invention, a support element fits between roof tiles and a roofing surface to provide support for the roof tiles. Preferred embodiments of the present invention further include roof tile support systems and methods for installing roof tile supports.

In one embodiment of the present invention, a support element is preferably wedge-shaped to correspond to the space between the tiles and the roofing surface and to provide support under as much of the tile as possible. The wedge-shaped support element is preferably made of expanded polystyrene so that it is lightweight, durable, semi-compressible, fire safe, inexpensive and easy to manufacture and install. Roof tiles placed on the wedge-shaped support element are preferably supported by the support element, and rest on the back end portion of the next lower course of tiles. This allows downward forces acting on a tile to be distributed over the tile and through the support element to the roofing surface. This distribution of the forces prevents the tile from breaking.

Support elements are preferably independent of the roof tiles. Individual support elements can be mass-produced for use with different, but similar, kinds of tile. Additionally, during installation the roof tiles can be adjusted forward or backward with respect to the support element in order to increase or decrease the head lap of the tiles. Support elements that are not attached to tiles are more cost effective in terms of packaging and delivery than combined structures.

Another preferred embodiment of the invention is a roof tile support system with a roofing surface, roof tiles, and support elements. The support elements are preferably positioned between the roofing surface and the tiles in a manner suitable for distributing and transferring concentrated forces acting on the tiles more evenly to the roofing surface. Distributing and transferring the forces increases the load capacities of the tiles and improves the walkability of the roof.

One of the preferred methods for installing roof tile supports comprises placing a support element on a roofing surface, placing a roof tile over the support element, and securing the roof tile to the roofing surface.

DETAILED DESCRIPTION OF THE PREFERRED EMBODIMENT

Figure 1:
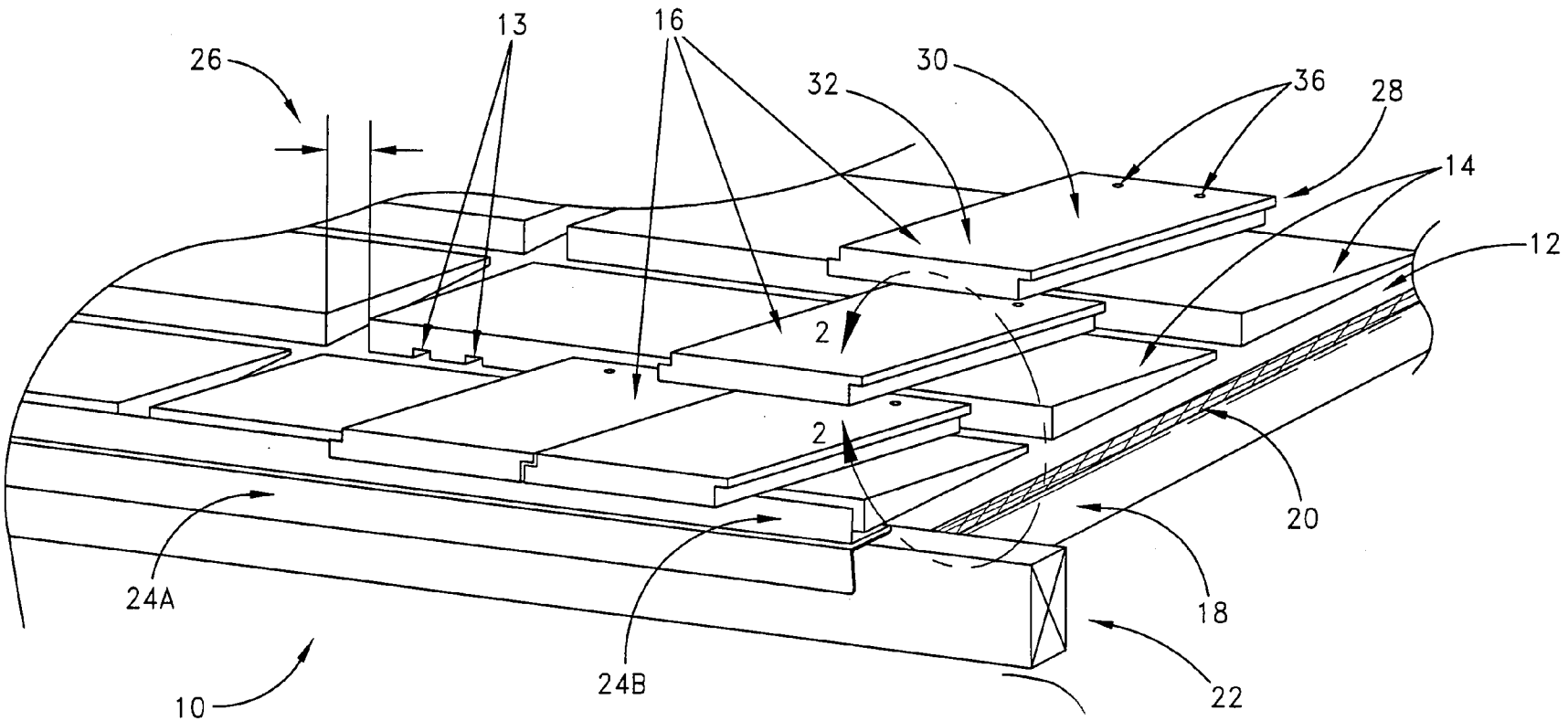
FIG. 1 is a perspective view, partly in cross-section, of a roof tile support system illustrating one embodiment of the present invention.

One embodiment of the invention is illustrated in FIG. 1, in which a roof tile support system 10 is shown covering a portion of a roof. A roofing surface 12 is shown. Several roof tile support elements 14 are shown resting on the roofing surface 12. Finally, several roof tiles 16 are shown resting on the roof tile support elements 14 and the roofing surface 12.

Preferably, the roofing surface 12 is a structure capable of receiving and supporting a tile roof. In a preferred embodiment of the invention, the roofing surface 12 is a supported plywood deck 18 covered by tarpaper 20. In other embodiments of the invention, the roofing surface 12 also includes battens to which roof tiles 16 are attached. In the preferred embodiment of FIG. 1, one end of the roofing surface 12 has a wooden cross member 22 to which the eave metal 24*a,b* of the roof is attached. One skilled in the art will be familiar with other variations or combinations of materials constituting a roofing surface 12.

In a preferred embodiment of the invention, a roof tile support element 14 fits between roof tiles 16 and a roofing surface 12 to provide support for the roof tiles 16. Preferably, a support element 14 is wedge-shaped to correspond to the space between the tiles 16 and the roofing surface 12 and to provide support under as much of the tile 16 as possible. The support element 14 is preferably made of expanded polystyrene so that it is lightweight, durable, semi-compressible, fire safe, inexpensive and easy to manufacture and install. Alternatively, the support element 14 may be made of other materials such as foam, rubber, plastic, or any other material which provides sufficient support when used as described herein.

The support element 14 preferably rests directly on the roofing surface 12. Support elements 14 are preferably arranged in rows on the roofing surface 12. A support element 14 in a row is preferably one or two inches away 26 from the next support element 14 in the row. The space 26 between the support elements 14 is preferred to facilitate water drainage on the roof.

In a preferred embodiment of the invention a roof tile 16 is a roof-covering product that is brittle, subject to fracture, or likely to break under the weight of an individual walking on an installed roof. In a particular preferred embodiment illustrated in FIG. 1, the roof tile 16 is a lightweight concrete tile in a shake or slate profile. The roof tile 16 has a back end portion 28 which is preferably supported by the thinner end of the support element 14 such that it does not contact the roofing surface 12, thereby "floating" the roof tile 16 above the roof surface 12. A middle portion 30 of the roof tile 16 preferably rests on the support element 14. A front end portion 32 of the roof tile 16 overlaps the back end portions 28 of the tiles 16 of the next lower course. In this configuration, each roof tile 16 effectively floats on the support element 14. This allows for loads to be evenly distributed across the tiles 16, support elements 14, and roof surface 12 respectively.

Figure 3:
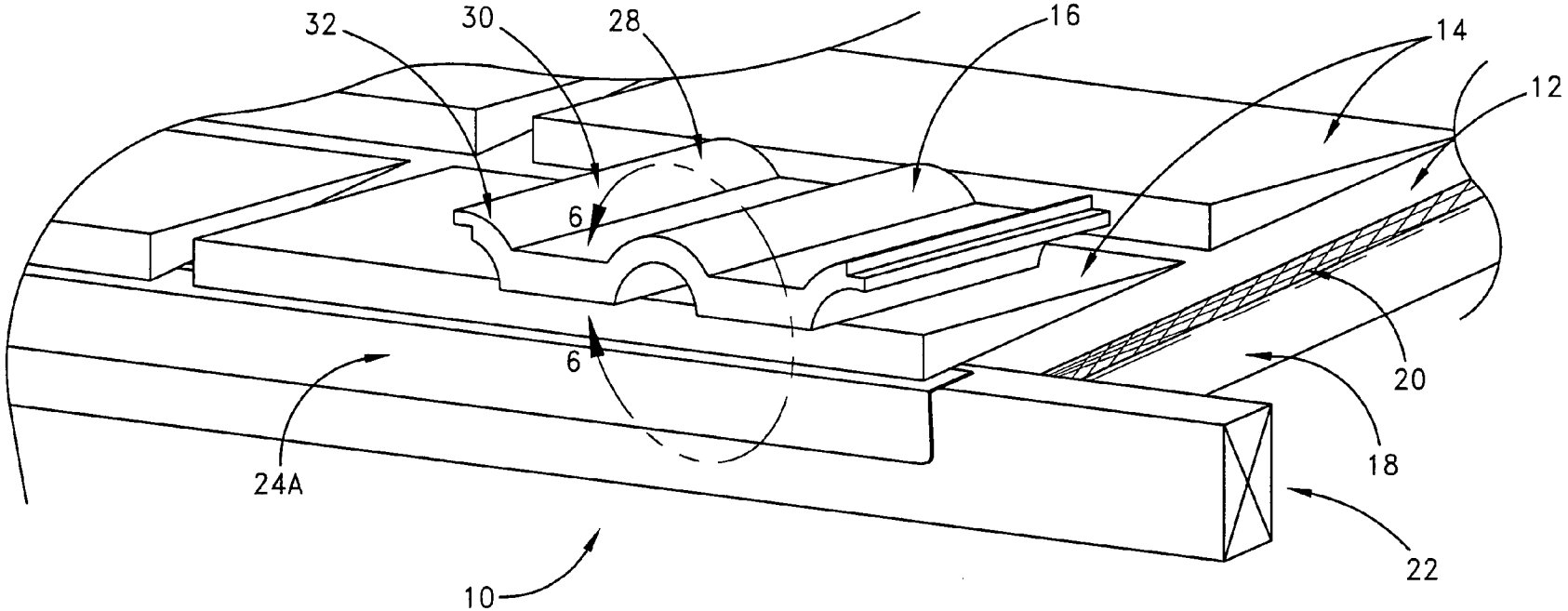
FIG. 3 is a perspective view, partly in cross-section, of another embodiment of a roof tile support system.
Figure 4:
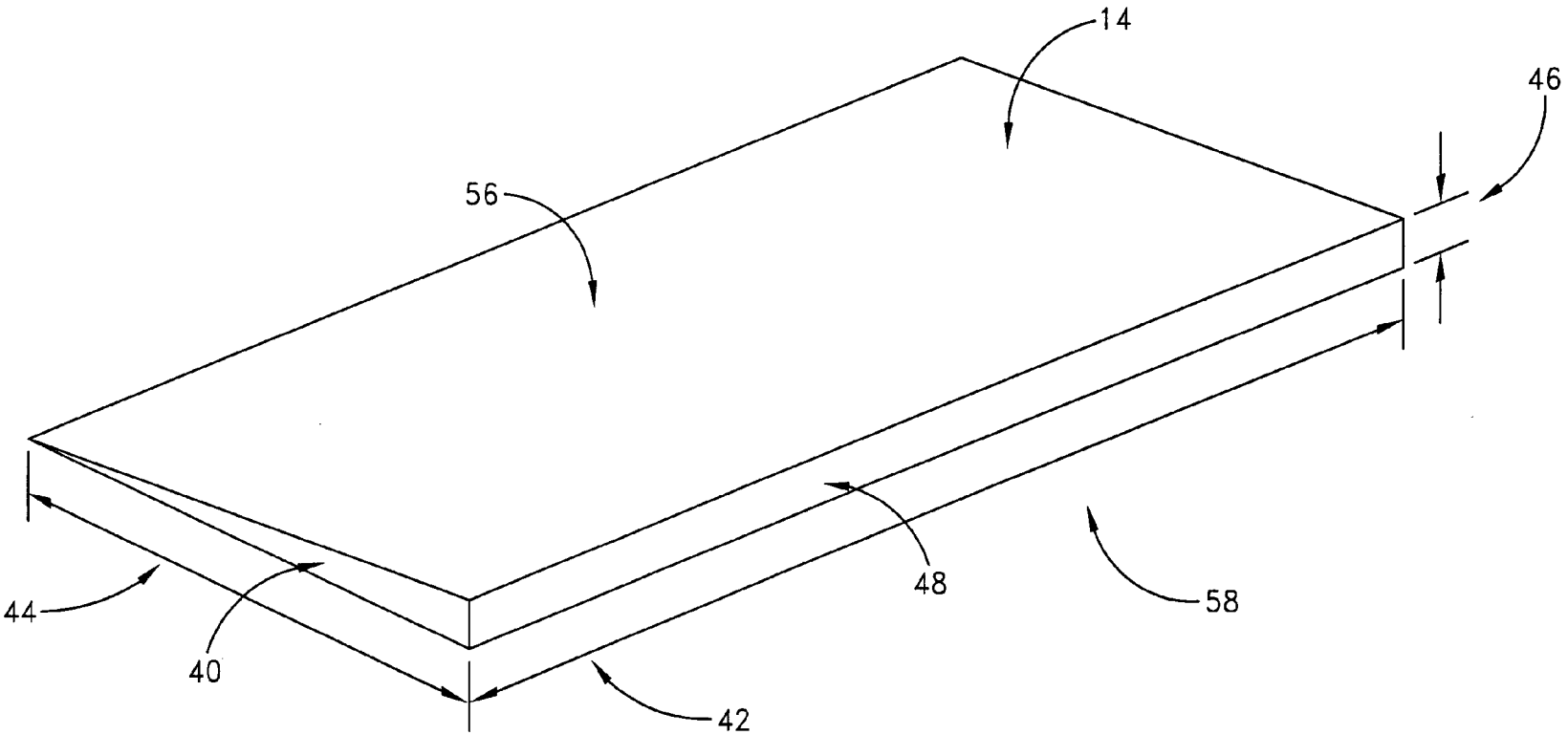
FIG. 4 is a perspective view of a roof tile support element according to one embodiment of the present invention.

In an alternative embodiment, the support element 14 may have a triangular cross-section as illustrated in FIGS. 3 and 4. In this embodiment, the roof tile 16 may be positioned on the support element 14 such that the back end portion 28 rests on the roofing surface 12. In this particular embodiment, the roofing tile is partly supported by the roofing surface 12 as well as by the support element 14.

Figure 2:
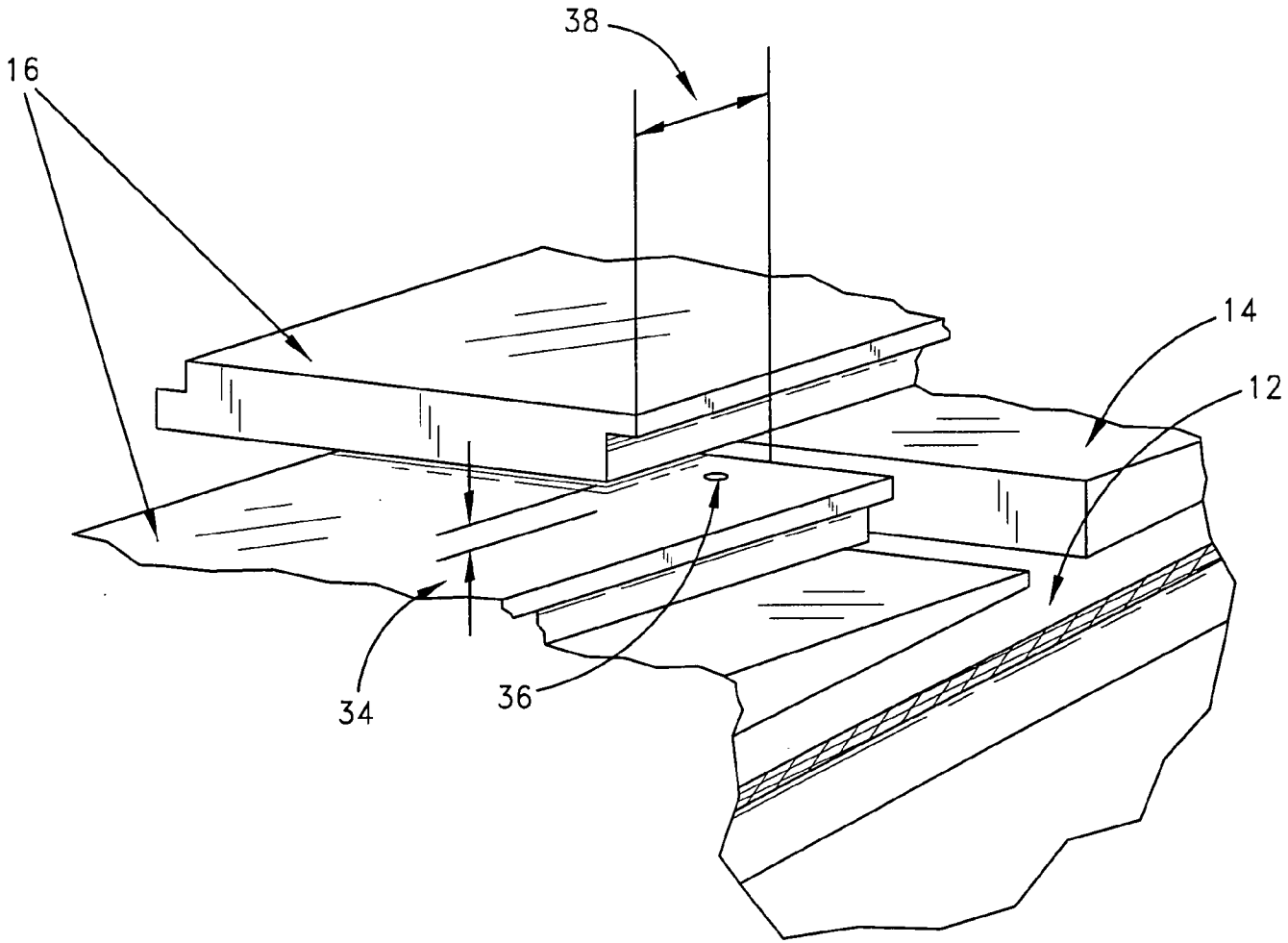
FIG. 2 is a perspective view of a portion of the roof tile support system of FIG. 1.

In a preferred embodiment shown in FIG. 2, roof tiles 16 placed on the wedge-shaped support element 14 preferably rest on the next lower course of tiles 16. This allows downward forces acting on a tile 16 to be distributed over the tile 16 and through the support element 14 to the roofing surface 12. This distribution of the forces prevents the tile 16 from breaking. Preferably, roof tiles 16 placed on the support elements 14 will rest directly on the next lower course of tiles 16.

The roof tiles 16 are preferably secured in place using nails 36 appropriate for use with roof tiles 16. As illustrated in FIG. 2, the nails 36 may pass through both the roof tile 16 and the support element 14. In other embodiments, the nails 36 may only pass through the roof tiles 16. Support elements 14 are preferably independent of the roof tiles 16. During installation, roof tiles 16 can be adjusted forward or backward with respect an independent support element 14 in order to increase or decrease the amount of overlap 38 of the tiles 16.

Another preferred embodiment of the invention is illustrated in FIG. 3, in which a roof tile support system 10 is shown covering a portion of a roof. A roofing surface 12 is shown comprising a roof deck 18 and a layer of tarpaper 20. One end of the roofing surface 12 has a wooden cross member 22 to which the eave metal 24*a* of the roof is attached. Several wedge-shaped roof tile support elements 14 are shown resting on the roofing surface 12. Finally, a roof tile 16 is shown resting on a roof tile support element 14.

In a particular preferred embodiment illustrated in FIG. 3, the roof tile 16 is a lightweight concrete tile in a barrel profile. The roof tile 16 has a back end portion 28 that preferably rests on the support element 14. A middle portion 30 of the roof tile 16 preferably rests on the support element 14 as well. A front end portion 32 of the roof tile 16 is shown overhanging the edge of the roof. Generally, in higher rows, the front end portion 32 of a roof tile 16 preferably overlaps the back end portions 28 of the tiles 16 of the next lower course.

The barrel roof tiles 16 that are placed on the wedge-shaped support elements 14 are preferably supported by the support elements 14, but rest directly on the next lower course of tiles 16. Preferably, roof tiles 16 placed on the support elements 14 will rest on the back end portion 28 of the next lower course of tiles 16.

Figure 6:
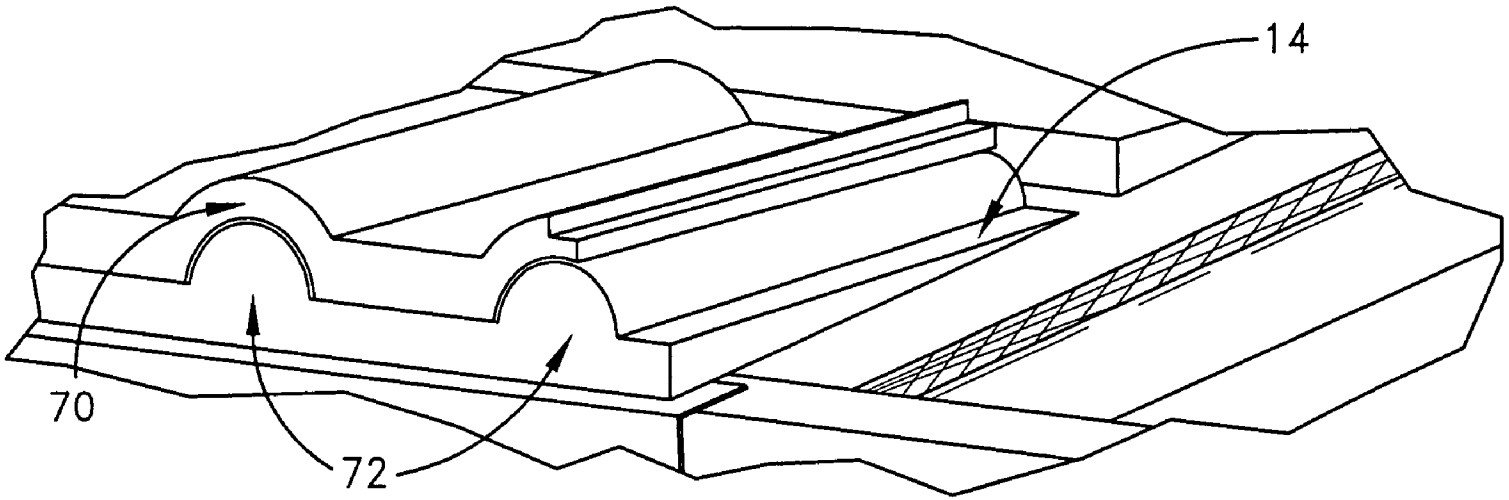
FIG. 6 is a perspective view in cutaway of an alternative embodiment of a roof tile support element for the roof tile of FIG. 3.

In another preferred embodiment, as shown in FIG. 6, the support element 14 has arched sections 72 corresponding to the barrel sections 70 of the roof tiles. The arch sections 72 may be integrally formed with the rest of the support element 14 such that a shape similar to the underside of the barrel roof tile 16 is created. Alternatively, the arch sections 72 may be separate or detachable from the rest of the support element 14, in which case the arch sections 72 may be held in place by glue, tape, or simply by friction. FIG. 6 shows the support element with a triangular cross-section, however, a support element having features and advantages of the present invention may also have a quadrilateral cross-section in combination with the arch sections 72 described above.

One embodiment of the invention, shown in FIG. 4, is a roof tile support element 14. Support elements 14 are preferably independent of roof tiles. Individual support elements 14 can be mass-produced for use with different, but similar, kinds of tile. The support element 14 is preferably made of expanded polystyrene. The support elements 14 are preferably cut from a large block of expanded polystyrene with a hot wire.

In a particular preferred embodiment shown, the support element 14 is wedge-shaped. The wedge-shaped support element 14 has a triangular cross-section 40. The support element preferably has a top surface 56 for contacting roof tiles and a bottom surface 58 for contacting a roofing surface. Preferably, the large surface areas on the top and bottom of the support element are in contact with substantial portions of the roof tiles and the roofing surface. The support element 14 is preferably long enough to support between three and five roof tiles. Other embodiments, however, may support more or fewer tiles. The support element 14 is preferably four feet long 42.

The width 44 and the height 46 of the support element 14 will vary depending on the specific shape and size of the roof tiles with which the support element is designed to be compatible. Preferably, the height 46 at the front end 48 of the support element 14 will be about 0.125" higher than the height of the back end portion of a roof tile on the next lower course. The width 44 of the support element 14 is preferably wide enough that its bottom surface 58 covers a majority of the roofing surface directly below the middle portions of corresponding roof tiles. The width 44 of the support element 14 is preferably wide enough that its top surface 56 contacts a majority of the surface under the middle portions of corresponding roof tiles.

For example, a roof tile support element 14, with a triangular cross section 40, may be designed to be compatible with roof tiles that are approximately 15" long, 12" wide and 1" tall. The front end portion of the roof tile may be intended to overlap a lower course of tiles by about 3" with the back end portion of the tile intended to be in contact with a roofing surface for about 1". The front end portion of the roof tile may be supported above the back end portion next lower course of roof tiles. According to one embodiment as shown in FIGS. 1 and 2, the distance 34 that a roof tile 16 should be supported above the next lower course of tiles 16 is related to the compressibility of the support element 14. When someone walks on the tile roof supported by support elements 14 with a triangular cross section, the support element 14 will be compressed and the distance between the upper and lower tiles 16 will decrease.

A roof tile support element 14 designed to be compatible with such a tile could be four feet long 42, 11" wide 44, and 1.125" tall 46. In such an arrangement, four tiles could be placed over the support element 14. The bottom surface of the support element 14 would be covering a majority of the roofing surface directly below the middle portions of the four roof tiles. The middle portions of the lower surfaces of the four roof tiles would be in contact with the top surface 56 of the support element 14. A majority of the surface area under the roof tile, that is not overlapping lower tiles or in contact with the roofing surface, would be supported by the support element 14.

Other embodiments of the support element 14 may effectively support roof tiles by contacting less than a majority of the surface under the middle of the tiles. Some tiles with barrel profiles, for example, may be supported sufficiently even though the top surface of the support element may not contact a majority of the bottom surface of the middle of the tiles. Preferably, support elements contact and support roof tiles at selected locations on the underside of the tiles to generally provide support to the otherwise unsupported middle sections of the tiles.

Figure 5:
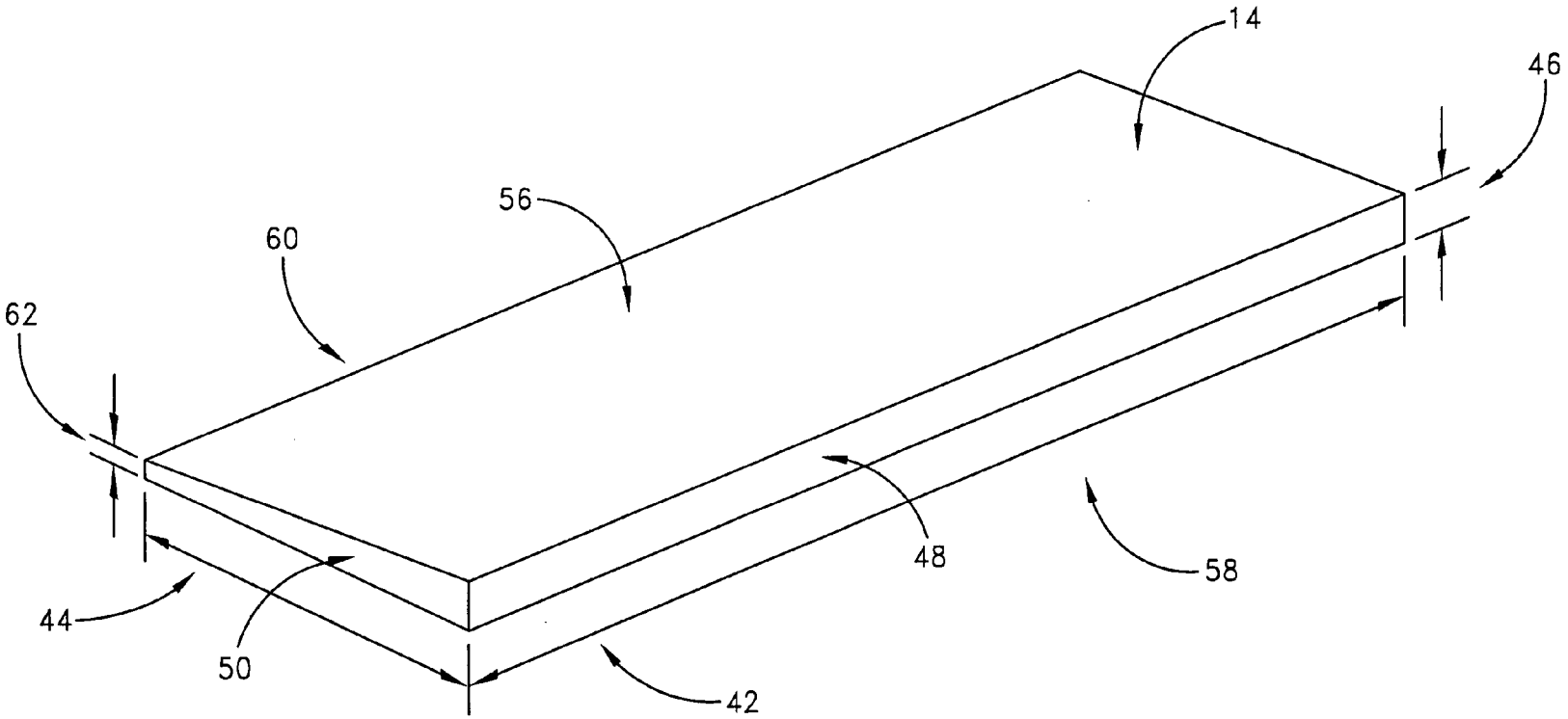
FIG. 5 is a perspective view of another embodiment of a roof tile support element.

In a similar preferred embodiment shown in FIG. 5, the support element 14 is again wedge-shaped. However, the wedge-shaped support element 14 has a quadrilateral cross-section 50 rather than a triangular cross-section. The support element preferably has a thicker front end 48 and a thinner back end 60. The support element preferably has a top surface 56 for contacting roof tiles and a bottom surface 58 for contacting a roofing surface. Preferably, the large surface areas on the top and bottom of the support element are in contact with substantial portions of the roof tiles and the roofing surface.

A support element with a quadrilateral cross-section 50 may be preferable with certain shapes, sizes or types of tiles. In one preferred embodiment, the support element 14 is compatible with roof tiles requiring battens on the roofing surface. In other embodiments the support element 14 is compatible with roof tiles which may or may not require battens.

The thinner back end 60 of a support element 14 can be placed adjacent to a batten. The height 62 of the thinner back end 60 of the support element 14 is preferably the same height or slightly higher than the batten. Preferably, the height 46 at the thicker front end 48 of the support element 14 will be about the same as the height of the back end portion of the roof tile and batten of the next lower course.

The width 44 of the support element 14 is preferably wide enough for the bottom surface 58 of the support element to contact and cover a majority of the roofing surface under the middle portions of the corresponding roof tiles. Additionally, the width 44 of the support element 14 is also preferably wide enough that its top surface 56 contacts a majority of the surface under the middle portions of corresponding roof tiles. However, as noted previously, other embodiments may effectively support the tiles by contacting less than a majority of the surface under the middle of the tiles.

In one specific preferred embodiment, a support element 14 is compatible with an Eaglelite Malibu tile to be installed on a roofing surface with battens. The support element 14 for use with this type of tile is four feet long 42 and 11" wide 44. The height 46 of the thicker front end 48 is 1.875" and the height 62 of the thinner back end 60 is 1".

In another preferred embodiment, a support element 14 is compatible with a Monier Cedarlite tile. The support element 14 for use with this type of tile is four feet long 42 and 7.5" wide 44. The height 46 of the thicker front end 48 is 1" and the height 62 of the thinner back end 60 is 0.375". One skilled in the art will be familiar with these manufacturers and tiles.

Figure 7:
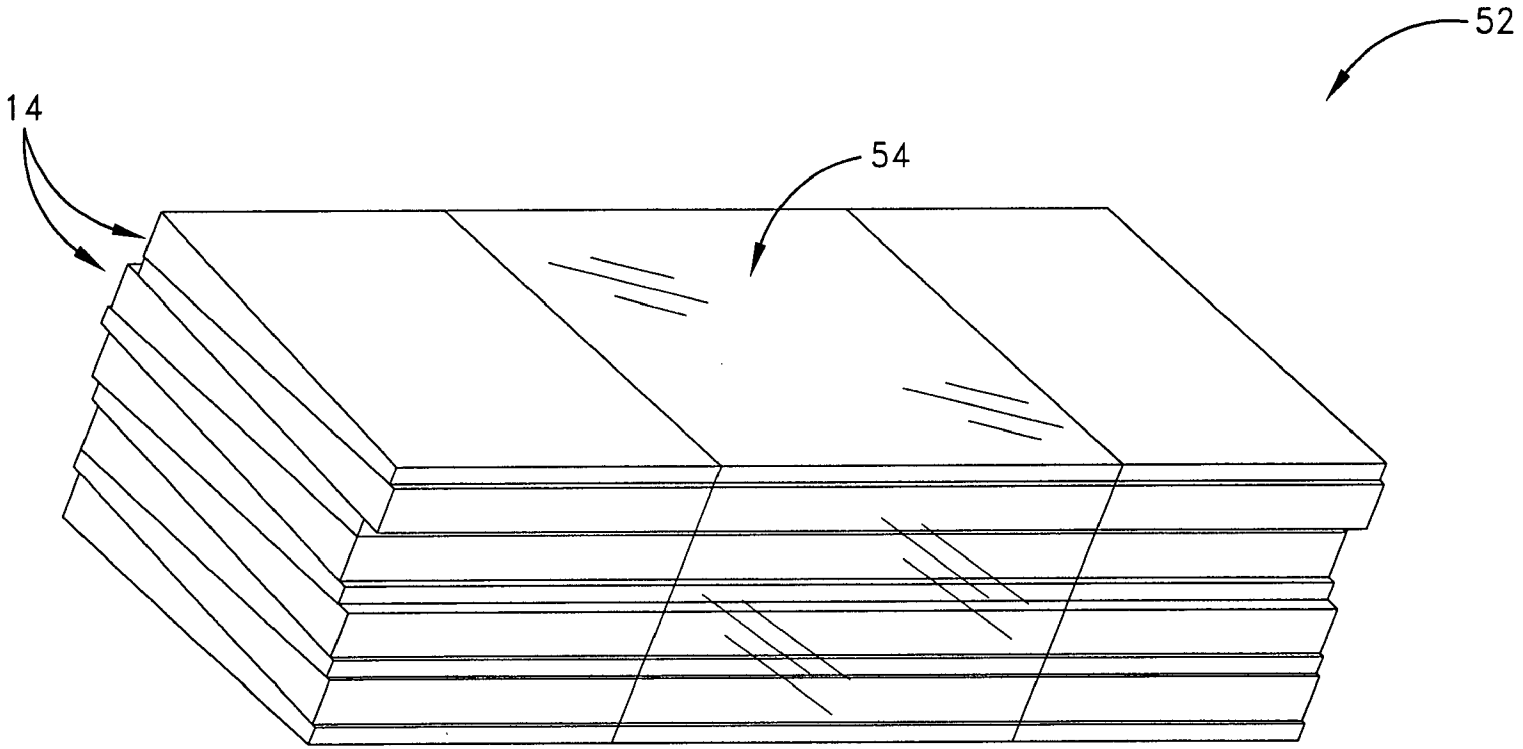
FIG. 7 is a perspective view of a packaging assembly illustrating a method of packaging a plurality of roof tile support elements.

FIG. 7 illustrates a preferred packaging assembly 52 of roof tile support elements 14. A number of support elements 14 are shown arranged into a bundle 52. The support elements 14 are preferably stacked in an alternating fashion such that each overlaying element 14 is turned 180° relative to the adjacent elements 14 stacked thereby. The support elements 14 are preferably bound with a plastic wrap 54 or some other method of binding. In another preferred embodiment the support elements 14 are packaged in bags. Support elements 14 that are independent of roof tiles are more cost effective in terms of packaging and delivery than combined structures.

A preferred method of installing roof tile supports, comprises placing a support element on a roofing surface, placing a roof tile over a support element, and securing the roof tile to the roofing surface. Embodiments of the invention vary depending on the type of support elements and roof tiles used. In one preferred method, as seen in FIG. 3, the roof tile 16 is placed so that it is in contact with, and rests completely on, the support element 14. In another embodiment, an example of which is shown in FIG. 1, the roof tile 16 is placed so that it rests on the support element 14 and the roofing surface 12. In another method, the roof tile 16 may be placed so that it rests on a support element 14 and the tiles 16 of the next lower course. In still another embodiment, the roof tile 16 may be placed so that it rests on the roofing surface 12, the support element 14, and the tiles 16 of the next lower course.

Preferably, the roof tiles 16 are placed over the support elements 14 and then secured to the roofing surface using roofing nails 36, such as shown in FIG. 1. In a preferred method of installation the nail 36 passes through both the roof tile 16 and the support element 14 and into the roofing surface 12 to secure the tile 16. In another preferred method, the nail 36 passes through the tile 16 and into the roofing surface 12 and the weight of the tile 16 acts to secure the support element 14. One preferred method of installing roof tile supports 14 includes positioning a second support element 14 in a row next to a first support element 14, leaving a gap 26 between the two elements 14 to facilitate water drainage on the roof. Alternatively, water drainage may be further facilitated by forming grooves 13 in the bottom surface of the support elements 14, e.g. the surface which contacts the roofing surface 12. Such grooves 13 would allow water to flow underneath each support element 14 as well as between them.

Although preferred embodiments of the present invention have been described herein, it will be understood by those of ordinary skill in the art that certain obvious modifications and departures from these embodiments can be made without departing from the spirit or essential characteristics of the invention.

What is claimed is:

1. A roof tile support system, comprising:

a roofing surface;

a plurality of roof tiles, each having an undersurface, said undersurface having a front end portion, a middle portion and a back end portion; and a plurality of independent, generally wedge-shaped support elements constructed from a compressible material, the support elements being sized and adapted to contact at least the middle portion of the undersurface of the roof tiles, but not the entire undersurface of the roof tiles, such that at least either the front end portion or the back end portion of the undersurface of the roof tiles overhangs the support elements, the support elements being positioned between and in contact with both of said roofing surface and said roof tiles, wherein said support elements are arranged on the roof surface in at least a lower row and an upper row, and with the support elements in each row having a space between adjacent support elements; wherein said support elements support said roof tiles so as to increase the load capacities of said roof tiles, and wherein each support element is configured to support more than one roof tile of any shape in a single course; and wherein the support elements are not specially adapted or shaped with respect to the roof tiles, such that the roof tiles are independently installable on the support elements so that their position thereon is adjustable during installation.

2. The roof tile support system of claim 1, wherein the plurality of roof tiles float on the plurality of support elements, whereby each individual roof tile is supported against breakage by at least one support element.

3. The roof tile support system of claim 1, wherein said roof tiles are arranged in courses and an upper course is supported by said support elements such that front portions of the roof tiles of the upper course contact back end portions of tiles in an adjacent lower course of roof tiles.

4. The roof tile support system of claim 1, wherein at least one roof tile comprises a back end portion which overlaps a rear end of the support element on which it is supported.

5. The roof tile support system of claim 4, wherein the back end portion of the said at least one roof tile is in contact with the roof surface.

6. The roof tile support system of claim 1, wherein said roof tiles are arranged in courses and a first course is supported by said support elements such that front end portions of the roof tiles of the upper course overlap back end portions of tiles in an adjacent lower course of roof tiles.

7. The roof tile support system of claim 6, wherein an amount by which the roof tiles in the upper course overlap the tiles in the adjacent lower course is configured to be adjustable during installation.

8. The roof tile support system of claim 7, wherein said support elements have arch sections, and said roof tiles are barrel roof tiles.

9. The roof tile support system of claim 7, wherein said support elements have a triangular cross-section.

10. The roof tile support system of claim 7, wherein said support elements have a quadrilateral cross-section.

11. The roof tile support system of claim 1, wherein said support elements are made of expanded polystyrene.

12. The roof tile support system of claim 1, wherein said roof tiles are arranged in courses and an upper course is supported by said support elements such that front end portions of the roof tiles of the upper course are elevated some distance above rear end portions of tiles in an adjacent lower course of roof tiles.

13. The roof tile support system of claim 1, wherein said roof tiles are supported by said support elements such that the weight of said tiles, or a concentrated load on said tiles, will be distributed over said support elements and said roofing surface.

* * * * *

UNITED STATES PATENT AND TRADEMARK OFFICE

CERTIFICATE OF CORRECTION

PATENT NO. : 6,948,288 B1
APPLICATION NO. : 09/692655
DATED : September 27, 2005
INVENTOR(S) : Gary E. Smith It is certified that error appears in the above-identified patent and that said Letters Patent is hereby corrected as shown below:

At column 3, line 30, delete “24a,b” and insert -- 24a, b --, therefor.

At column 5, line 38, delete “cross section” and insert -- cross-section --, therefor.

At column 5, line 50, delete “cross section,” and insert -- cross-section, --, therefor.

Signed and Sealed this

Fifth Day of June, 2007

JON W. DUDAS
*Director of the United States Patent and Trademark Office*